US009548037B2

(12) United States Patent
Jang et al.

(10) Patent No.: US 9,548,037 B2
(45) Date of Patent: Jan. 17, 2017

(54) LIQUID CRYSTAL DISPLAY WITH ENHANCED DISPLAY QUALITY AT LOW FREQUENCY AND DRIVING METHOD THEREOF

(71) Applicant: Samsung Display Co., Ltd., Gyeonggi-do (KR)

(72) Inventors: Dae-Gwang Jang, Yongin (KR); Seok Ha Hong, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 68 days.

(21) Appl. No.: 14/142,241

(22) Filed: Dec. 27, 2013

(65) Prior Publication Data

US 2014/0354619 A1 Dec. 4, 2014

(30) Foreign Application Priority Data

May 31, 2013 (KR) ..... 10-2013-0063041

(51) Int. Cl.
*G09G 3/36* (2006.01)

(52) U.S. Cl.
CPC ..... *G09G 3/3696* (2013.01); *G09G 2320/10* (2013.01); *G09G 2330/022* (2013.01)

(58) Field of Classification Search
CPC ..... G09G 2300/0823; G09G 2310/0254–2310/0256; G09G 3/3614–3/3644
See application file for complete search history.

(56) References Cited

U.S. PATENT DOCUMENTS

| | | | | |
|---|---|---|---|---|
| 7,528,821 | B2 | 5/2009 | Baek et al. | |
| 8,102,350 | B2 | 1/2012 | Jang | |
| 8,362,991 | B2 | 1/2013 | Lee et al. | |
| 2003/0038766 | A1* | 2/2003 | Lee et al. | 345/87 |
| 2007/0040795 | A1 | 2/2007 | Lee et al. | |
| 2007/0279360 | A1* | 12/2007 | Park et al. | 345/94 |
| 2010/0156928 | A1* | 6/2010 | Lee et al. | 345/589 |
| 2012/0169696 | A1 | 7/2012 | Kim et al. | |

FOREIGN PATENT DOCUMENTS

| | | | |
|---|---|---|---|
| KR | 10-2000-0018588 | A | 4/2000 |
| KR | 10-0324438 | | 1/2002 |
| KR | 10-0480180 | | 3/2005 |
| KR | 10-2005-0033731 | A | 4/2005 |
| KR | 10-0620137 | | 8/2006 |
| KR | 10-2008-0048716 | A | 6/2008 |
| KR | 10-0955377 | A | 4/2010 |
| KR | 10-2011-0055069 | A | 5/2011 |

* cited by examiner

*Primary Examiner* — Sanghyuk Park
(74) *Attorney, Agent, or Firm* — Lee & Morse, P.C.

(57) ABSTRACT

A controller for a liquid crystal display includes a data driver and a gate driver. The data driver applies data voltages having different polarities to a first pixel and a second pixel. The gate driver applies different gate-on voltages to a first gate line coupled to the first pixel and a second gate line coupled to the second pixel. The gate-on voltages have at least one of a different width or a different level when at least one of a still image or a moving picture is to be displayed. The different gate-on voltages translate into different pixel charging speeds, which may translate into improvements in the luminance and/or other properties of the display.

18 Claims, 9 Drawing Sheets

6(a)

6(b)

LIQUID CRYSTAL DISPLAY WITH ENHANCED DISPLAY QUALITY AT LOW FREQUENCY AND DRIVING METHOD THEREOF

CROSS-REFERENCE TO RELATED APPLICATION

Korean Patent Application No. 10-2013-0063041, filed on May 31, 2013, and entitled, "Liquid Crystal Display and Driving Method Thereof," is incorporated by reference herein in its entirety.

BACKGROUND

1. Field

One or more embodiments described herein relate to a display device.

2. Description of the Related Art

A liquid crystal display is one of the most widely used flat panel displays. A liquid crystal display may include two display panels equipped with electric field generating electrodes (such as a pixel electrode and a common electrode), a liquid crystal layer interposed between the two panels, a data driver for supplying data voltage, a gate driver for supplying a gate signal, and a signal controller for controlling the data driver and the gate driver. A liquid crystal display may also include a plurality of signal lines, such as gate lines and data lines for applying data voltages to pixel electrodes by controlling switching elements connected to the pixel electrodes.

Each pixel electrode may be connected to a switching element (such as a thin film transistor (TFT)) and receives the data voltage. An opposing electrode may be formed throughout an entire surface of the display panel and may receive a common voltage (Vcom). A desired image may be displayed by applying the data voltage and the common voltage to the pixel electrode and the opposed electrode, respectively. Applying these voltages generates an electric field in the liquid crystal layer. An intensity of the electric field may be controlled in order to control transmittance of light passing through the liquid crystal layer.

In one arrangement, the liquid crystal display may receive an input image signal from an external graphic controller. The input image signal stores luminance information of each pixel, and each pixel may be applied with a data voltage corresponding to desired luminance information. The data voltage applied to the pixel is represented as pixel voltage, according to a difference from the common voltage applied to the common electrode. Each pixel displays a luminance represented by a gray scale value of the image signal according to the pixel voltage.

In this case, the polarity of the data voltage for voltage which becomes a reference voltage for each frame, each row, each column, or each pixel may be inverted in order to prevent a degradation which occurs upon long-time application of a unidirectional electric field to the liquid crystal layer. Further, the polarities of pixel voltages represented by adjacent pixels may be different from each other, in order to prevent streaks such as vertical lines in a display screen from being generated.

In particular, the polarity of one pixel voltage may rise from a negative polarity to a positive polarity, and the polarity of another pixel voltage may fall from a positive polarity to a negative polarity. These polarities may be different from each other in response characteristics due to characteristics of the liquid crystal. For example, a rising speed of the pixel voltage may be lower than a falling speed of the pixel voltage when a general liquid crystal is driven. This difference in response speed may cause changes in luminance.

The change depending on response speed may not be substantially problematic when the liquid crystal display is driven at a high frequency, but the luminance difference may be visually recognized when the liquid crystal display is driven at a low frequency. Referring to a temporal contrast sensitivity function (TCSF), even though an actual luminance change is small particularly when the liquid crystal display is driven at a low frequency of 10 Hz or less, it is recognized as if the luminance change is large. As a result, a flicker may be viewed to thereby degrade display quality.

SUMMARY

In accordance with one embodiment, a liquid crystal display includes a liquid crystal display panel including a plurality of gate lines, a plurality of data lines, and a plurality of pixels arranged in a matrix pattern, each of the pixels connected to one of the gate lines and one of the data lines; a gate driver to apply gate-on voltages to the plurality of gate lines; a data driver to apply positive and negative data voltages to the data lines; and a signal controller configured to control the gate driver and the data driver, and to receive input data.

Additionally, the signal controller is configured to drive the data driver and the gate driver at a motion picture frequency when the input data corresponds to a motion picture and at a still image frequency when the input data corresponds to a still image, the still image frequency being lower than the motion picture frequency. The plurality of pixels includes a first pixel and a second pixel that receive data voltages having different polarities. The plurality of gate lines includes a first gate line connected to the first pixel and a second gate line connected to the second pixel, the first gate line and the second gate line receiving different gate-on voltages when displaying the still image. The different gate-on voltages may having different levels and/or different widths.

Also, when the data voltage applied to the first pixel is inverted from a positive polarity to a negative polarity, the gate-on voltage applied to the first gate line has a lower level than the gate-on voltage applied to the second gate line, and when the data voltage applied to the second pixel is inverted from a positive polarity to a negative polarity, the gate-on voltage applied to the second gate line has a lower level than the gate-on voltage applied to the first gate line.

Also, the first gate line and the second gate line receive gate-off voltages may have substantially a same level.

Also, the first gate line and the second gate line receive gate-on voltages having different widths.

Also, when the data voltage applied to the first pixel is inverted from a positive polarity to a negative polarity, the gate-one voltage applied to the first gate line has a smaller width than the gate-on voltage applied to the second gate line, and when the data voltage applied to the second pixel is inverted from a positive polarity to a negative polarity, the gate-on voltage applied to the second gate line has a smaller width than gate-on voltage applied to the first gate line.

Also, the gate-on voltage to one of the first gate line or the second gate line is applied is applied for a first period and the gate-on voltage to the other one of the first gate line or the second gate line is applied for a second period which is shorter than the first period.

Also, the gate-one voltages applied to the first gate line and the second gate line have different levels and different widths.

Also, when the data voltage applied to the first pixel is inverted from a positive polarity to a negative polarity, the gate-on voltage applied to the first gate line has a lower level and a smaller width than the gate-on voltage applied to the second gate line, and when the data voltage applied to the second pixel is inverted from a positive polarity to a negative polarity, the gate-on voltage of the second gate line has a lower level and a smaller width than the gate-on voltage applied to the first gate line.

Also, the first gate line and the second gate line receive different gate-on voltages when displaying the motion picture.

Also, the different gate-on voltages applied to the first and second gate lines when displaying the motion picture have at least one of different levels or different widths.

Also, the liquid crystal display is a dot inversion driving type in which polarities among pixels that are positioned on a row and a column are inverted in the plurality of pixels arranged in the matrix pattern.

In accordance with another embodiment, a driving method of a liquid crystal display includes receiving, by a signal controller, input data; identifying, by the signal controller, whether the input data corresponds to a motion picture or a still image; and controlling, by the signal controller, a liquid crystal display panel, a gate driver, and a data driver to display the still image at a still image frequency when the input data corresponds to the still image, and the liquid crystal display panel, the gate driver, and the data driver to display the motion picture at a motion picture frequency when the input data corresponds to the motion picture.

Additionally, the liquid crystal display includes a plurality of pixels including a first pixel and a second pixel that receive data voltages having different polarities. A plurality of gate lines includes a first gate line connected to the first pixel and a second gate line connected to the second pixel. The controlling operation may include applying, by the gate driver, different gate-on voltages to the first gate line and the second gate line when the still image is to be displayed.

Also, the different gate-on voltages may have at least one of different levels or different widths. The controlling may include applying gate-off voltages having substantially a same level to the first gate line and the second gate line.

Also, the controlling may include, when the data voltage applied to the first pixel is inverted from a positive polarity to a negative polarity, applying, by the gate driver, the gate-on voltage to the first gate line to have at least one of a lower level or a smaller width than the gate-on voltage applied to the second gate line, and when the data voltage applied to the second pixel is inverted from a positive polarity to a negative polarity, applying, by the gate driver, the gate-on voltage to the second gate line having at last one of a lower level or a smaller width than the gate-on voltage applied to the first gate line.

Also, the controlling may include applying, by the gate driver, different gate-on voltages to the first gate line and the second gate line when a moving picture is to be displayed. The liquid crystal display may be dot-inversion driven.

In accordance with another embodiment, a controller for a liquid crystal display includes a data driver to apply data voltages having different polarities to a first pixel and a second pixel; and a gate driver to apply different gate-on voltages to a first gate line coupled to the first pixel and a second gate line coupled to the second pixel, wherein the gate-on voltages have at least one of a different width or a different level. A level of at least one of the gate-on voltages is less than a level of at least one of the data voltages.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
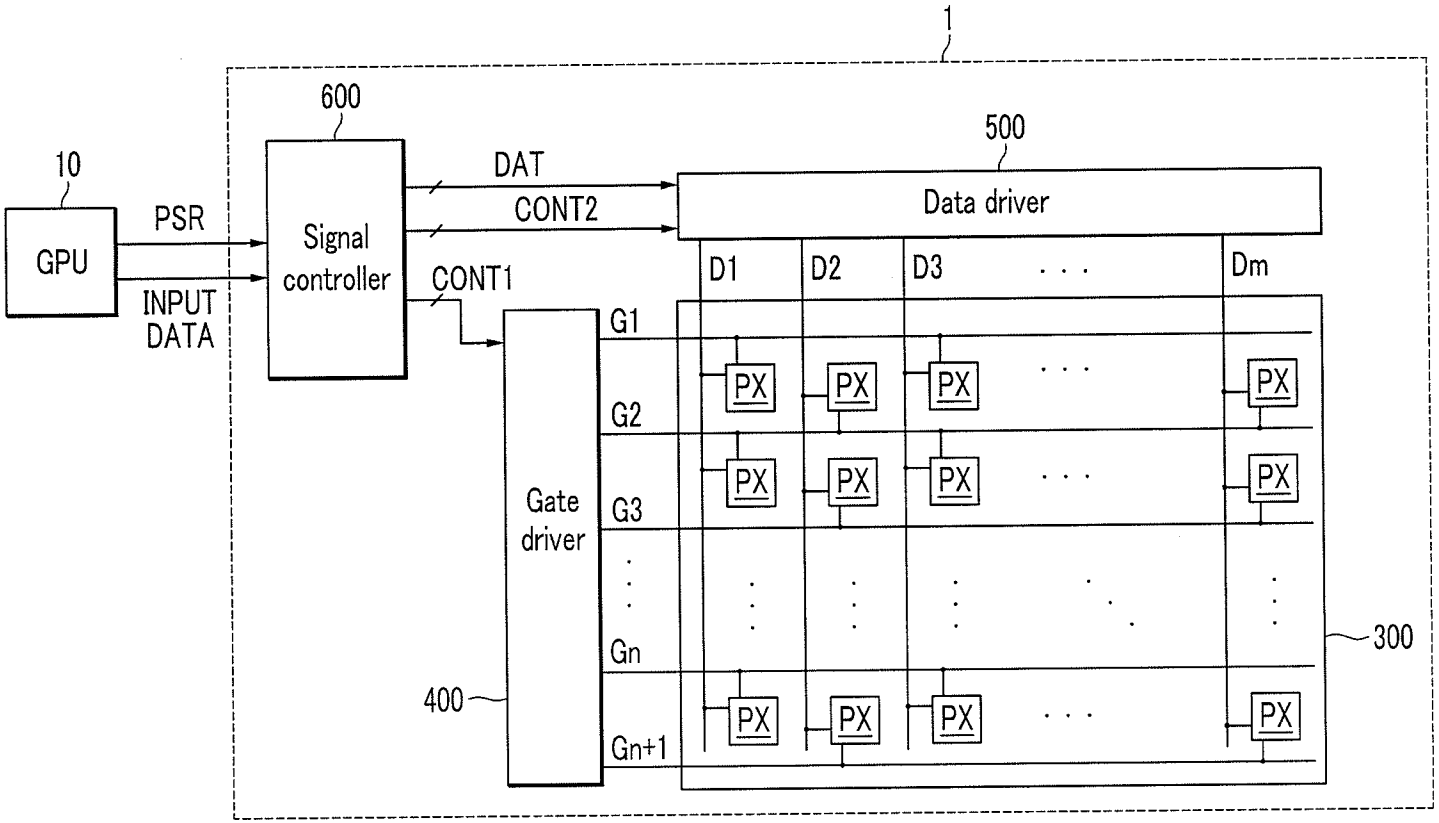
FIG. 1 illustrates an embodiment of a liquid crystal display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
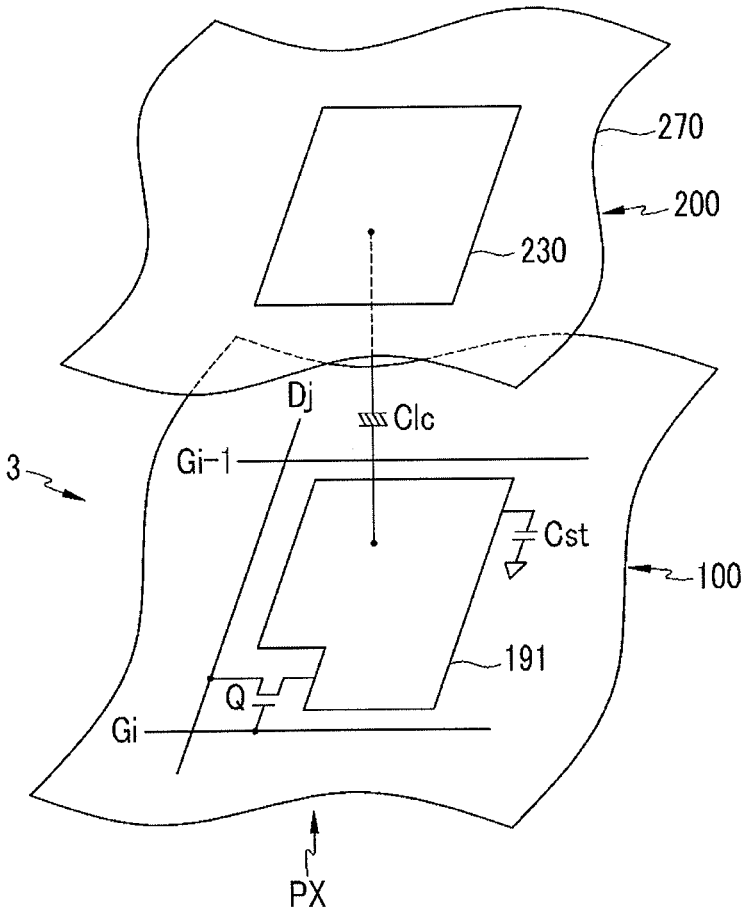
FIG. 2 illustrates an embodiment of one pixel in the liquid crystal display.

FIG. 1 shows one embodiment of a liquid crystal display, and FIG. 2 illustrates an equivalent circuit diagram of one pixel in the liquid crystal display. As illustrated in FIG. 1, the liquid crystal display 1 includes a liquid crystal display panel 300 displaying an image, a gate driver 400, a data driver 500, and a signal controller 600.

A graphic processing unit (GPU) 10 may be positioned outside the liquid crystal display 1. The graphic processing unit 10 may provide input data including data for the image to be displayed by the liquid crystal display 1, and a panel self-refresh (PSR) signal which is an identification signal to identify whether the corresponding image is a still image or a motion picture.

The liquid crystal display 1 receives the input data and the PSR signal from the graphic processing unit 10 and performs an operation of displaying the image depending on the input data. If it is determined that the corresponding image is a still image based on the PSR signal, the liquid crystal display 1 may display an image in an existing frame by itself again.

As shown in FIG. 2, the liquid crystal display panel 300 includes lower and upper display panels 100 and 200 that face each other, and a liquid crystal layer 3 interposed between the panels. The liquid crystal display panel 300 may also include a plurality of gate lines G1 to Gn+1 and a plurality of data lines D1 to Dm. The plurality of gate lines G1 to Gn+1 extends in a horizontal direction and the plurality of data lines D1 to Dm extends in a vertical direction, while being insulated from and crossing the plurality of gate lines G1 to Gn+1.

One of the gate lines G1 to Gn+1 and one of the data lines D1 to Dm are connected to one pixel PX. The pixels PXs are arranged in a matrix pattern, and each pixel PX may include a thin film transistor Q, a liquid crystal capacitor Clc, and a storage capacitor Cst. A control terminal of the thin film transistor Q may be connected to one of the gate lines G1 to Gn+1, an input terminal of the thin film transistor Q may be connected to one of the data lines D1 to Dm, and an output terminal of the thin film transistor Q may be connected to a pixel electrode 191. The pixel electrode 191 is coupled to one terminal of the liquid crystal capacitor Clc and to one terminal of the storage capacitor Cst. The other terminal of the liquid crystal capacitor Clc may be connected to a common electrode 270 and the other terminal of the storage capacitor Cst may be applied with storage voltage Vcst. A channel layer of the thin film transistor Q may be amorphous silicon, poly silicon, or an oxide semiconductor in an exemplary embodiment.

Pixels in one row may be alternately connected with a pair of gate lines that are positioned thereabove and therebelow. That is, one of the gate lines G1 to Gn+1 may be alternately connected to a pixel positioned thereabove and a pixel positioned therebelow. According to such a structure, odd numbered pixels and even numbered pixels that belong to one pixel row may be connected with different gate lines. In this case, the data lines D1 to Dm are connected to pixels that are positioned along one column, respectively.

The number of the gate lines G1 to Gn+1 may be larger than the number n of the pixel rows by one. In the exemplary embodiment of FIG. 1, since the pixel row does not exist above a first gate line G1, the first gate line G1 may be alternately connected only to a pixel row positioned therebelow. Also, since a pixel row does not exist below an n+1-th gate line Gn+1, the n+1-th gate line Gn+1 may be alternately connected only to a pixel row positioned thereabove.

The signal controller 600 processes the input data input from an external source, the PSR signal, and control signals. The control signals may include, for example, a vertical synchronization signal Vsync, a horizontal synchronization signal Hsync, a main clock signal MCLK, a data enable signal DE, and the like, so as to be suitable for an operational condition of the liquid crystal display panel 300 in response to the input data, the PSR signal, and the control signals. The signal controller 600 generates and outputs image data DAT, a gate control signal CONT1, a data control signal CONT2, and a clock signal based on the aforementioned input data and signals.

The gate control signal CONT1 may include a start pulse vertical signal STV instructing output starting of a gate-on voltage Von, a clock pulse vertical signal CPV controlling an outputting time of the gate-on voltage Von, and the like.

The data control signal CONT2 may include a start pulse horizontal signal STH instructing output starting of the image data DAT and a load signal TP instructing applying of a corresponding data voltage to the data lines D1 to Dm, an the like.

The signal controller 600 may allow the gate driver 400 and the data driver 500 to display a still image at a still image frequency and a motion picture at a motion picture frequency in the liquid crystal display panel, respectively, by using the gate control signal CONT1 and the data control signal CONT2. When a plurality of sequential frames has the same image data, a still image is displayed. When the frames have different image data, a motion picture is displayed. The signal controller 600 may identify whether the corresponding image is the motion picture or the still image based on the PSR signal.

In one embodiment, the signal controller 600 is configured to display the still image at a still image frequency lower than a motion picture frequency at which the image is displayed. For example, the still image frequency may have a value which is equal to or less than ⅔ of the motion picture frequency and may have a value which is equal to or more than 1 Hz. The still image and motion picture frequencies may have different values in other embodiments.

The plurality of gate lines G1 to Gn+1 of the liquid crystal display panel 300 are connected with the gate driver 400, the gate-on voltage Von is sequentially applied depending on the gate control signal CONT1 applied from the signal controller 600, and gate-off voltage Voff is applied when the gate-on voltage Von is not applied. The signal controller 600 may allow the gate driver 400 to apply the gate-on voltage Von that has levels, pulse widths, and the like, varied depending on the gate lines G1 to Gn+1 by using the gate control signal CONT1.

In an exemplary embodiment, the gate-on voltage Von is applied while being identified depending on the gate lines G1 to Gn+1 at the time of displaying the still image and is applied without identification depending on the gate line at the time of displaying the motion picture. However, according to other embodiments, the gate-on voltage Von may be applied while being identified depending on the gate lines G1 to Gn+1 even at the time of displaying the motion picture.

The plurality of data lines D1 to Dm of the liquid crystal display panel 300 is connected with the data driver 500. The data driver 500 receives the data control signal CONT2 and the image data DAT from the signal controller 600. The data driver 500 converts the image data DAT into data voltage by using gray scale voltage generated by a gray voltage generator, and transfers the converted data voltage to the data lines D1 to Dm. The data voltage includes a data voltage having a positive polarity and a data voltage having a negative polarity. A data voltage having a positive polarity and a data voltage having a negative polarity may be alternately applied based on a frame, and a row and/or a column for inversion driving. In one embodiment, inversion driving may be applied both when displaying a motion picture and when displaying a still image.

Figure 3:
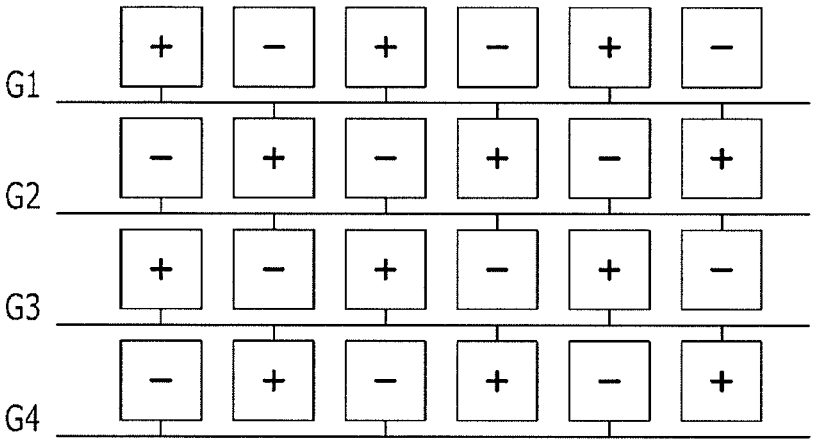
FIG. 3 illustrates an embodiment of a connection relationship between pixels and gate lines in a liquid crystal display.
Figure 4:
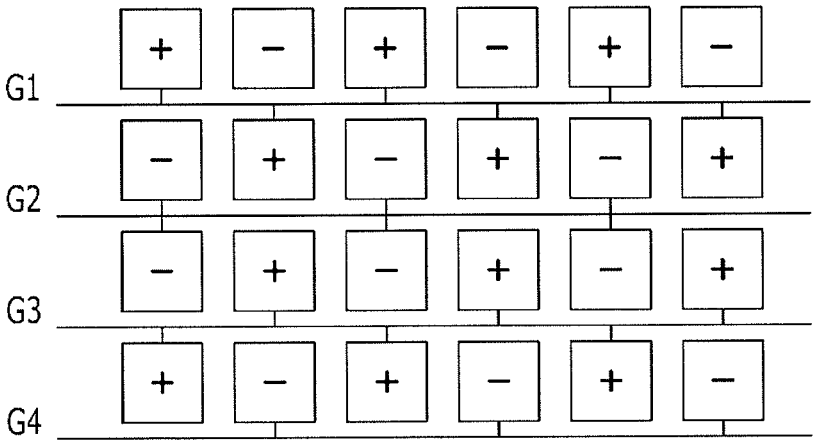
FIG. 4 illustrates another embodiment of a connection relationship between pixels and gate lines in a liquid crystal display.

In one embodiment, a data voltage having the same polarity may be applied to pixels connected to one (or a same) gate line. A pixel arrangement structure may be diversified. For example, FIG. 3 shows one embodiment of a connection relationship between pixels and gate lines in the liquid crystal display. FIG. 4 shows another embodiment of a connection relationship between pixels and gate lines in the liquid crystal display.

In FIG. 3, a part of a dot-inversion driving-type liquid crystal display panel in which data voltage is inversely driven among respective pixels provided on adjacent rows and columns is schematically illustrated. In FIG. 3, the gate lines G1 and G3 of the odd numbered rows are alternately connected to pixels that are positioned at upper and lower sides of the corresponding gate lines and are applied with data voltages having the same polarity (+). The gate lines G2 and G4 of the even numbered rows are alternately connected to pixels positioned at upper and lower sides of the corresponding gate lines and applied with voltage having the same polarity (−). In the case of the gate line G4, a pixel column that may be positioned at a lower side thereof is omitted and lines connected to the lower side are also omitted in the figure. Also, the data lines D1 to Dm may be connected to pixels that are positioned along respective columns.

In FIG. 4, a part of a 2-dot inversion driving-type liquid crystal display panel in which the polarity is inverted for each pixel in a row direction. The case where the polarity is inverted for each two columns in a column direction is schematically illustrated. Similar to FIG. 3, the gate lines G1 and G3 of the odd numbered rows are alternately connected to pixels that are positioned at upper and lower sides of the corresponding gate lines and applied with the data voltage having the same polarity (+). However, the gate lines G2 and G4 of the even numbered rows are connected to pixels that are positioned at upper and lower sides of the corresponding gate lines and applied with voltage having the same polarity (−) by the same vertical line. In the case of the gate line G4, a pixel column that may be positioned at a lower side thereof is omitted and lines connected to the lower side are also omitted in the figure.

Referring again to the pixel arrangement of FIG. 1 implemented with the pixel arrangement of FIG. 3, one row of pixels PXs may be alternately connected with a pair of gate lines positioned thereabove and therebelow. Further, the gate lines G1 to Gn+1 are also alternately connected to the pixels positioned at the upper side of the corresponding gate line and the pixels positioned at the lower side thereof. In the exemplary embodiment of FIG. 1, since a pixel row is not present above the first gate line G1, the gate line G1 is alternately connected to only the pixel row that is positioned therebelow.

Further, the number of the gate lines G1 to Gn+1 may be larger than the number n of the pixel rows by one. The first gate line G1 is connected to pixels that are positioned on odd numbered pixel columns of a first pixel row, and the second gate line G2 is connected to pixels that are positioned on odd numbered pixel columns of a second pixel row and even numbered pixel columns of the first pixel row. In this case, the data lines D1 to Dm are connected with pixels that are positioned along respective columns.

Such a connection in which odd numbered pixels and even numbered pixels that belong to one pixel row are connected to different gate lines G1 to Gn+1 has an advantage, in that although the data voltage applied to the data lines D1 to Dm has the same polarity, the connection makes it possible to drive a dot inversion in the entire liquid crystal display panel 300.

Figure 5:
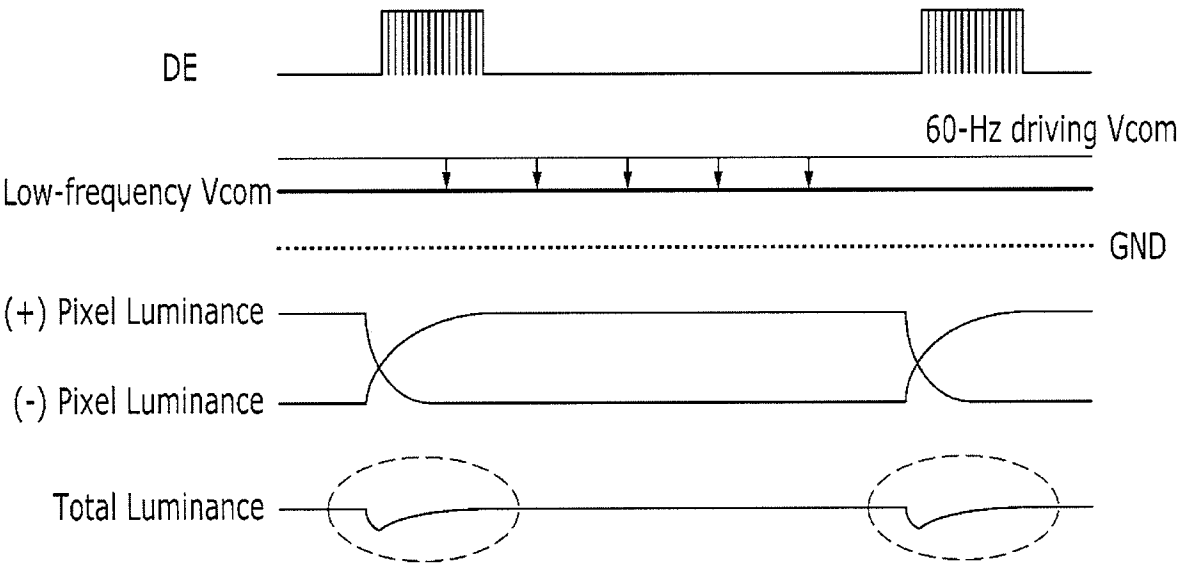
FIG. 5 illustrates an embodiment of controlling pixel voltage depending on a rising response speed and a falling response speed, and a change in the entire luminance of the display based on the controlled pixel voltage.

FIG. 5 is a waveform diagram illustrating a characteristic in accordance with one embodiment which pixel voltage is charged and a change in entire luminance which is generated due to the characteristic.

In FIG. 5, a speed at which a pixel charged with positive data voltage is charged with negative data voltage in response to the data enable (DE) signal and a speed at which the pixel charged with negative data voltage is charged with positive data voltage in response to the data enable (DE) signal are different from each other. That is, a rising response speed (at which the polarity of the pixel voltage is changed from a negative value to a positive value) is lower than a falling response speed (at which the polarity of the pixel voltage is changed from the positive value to the negative value).

The difference in response speed causes a change of luminance, in which luminance slowly increases to a same level as other section after luminance decreases as compared with other section, in a section in which rising and falling occur as illustrated in a lower end of FIG. 3, in entire luminance. Such a luminance change is visually recognized as if the luminance is significantly changed particularly, when the still image frequency is a low frequency of 10 Hz or less, and considered as a flicker. Therefore, it is recognized that for low-frequency driving without degradation of display quality, the luminance change which occurs depending to the charging characteristic of the pixel voltage needs to be further small.

In one embodiment, a scheme is provided which allows the liquid crystal display to be driven at a still lower frequency by decreasing the difference between the rising response speed and the falling response speed, in order to make the luminance change smaller in a section where the rising and the falling. Decreasing the difference between the rising response speed and the falling response speed may correspond to a decrease in the falling response speed. The scheme may control the pixel voltage charged by controlling the gate-on voltage and an exemplary embodiment associated therewith will be described below with reference to FIGS. 6 to 9. In some cases, decreasing the difference between the rising response speed and the falling response speed may correspond to increasing the rising response speed.

Figure 6:
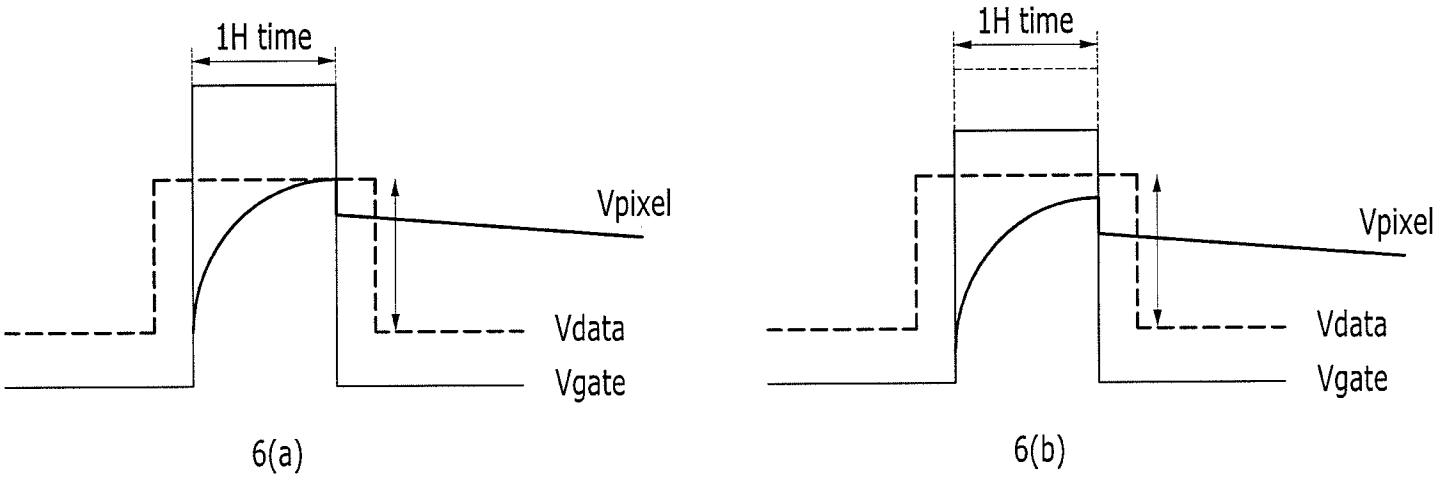
FIG. 6 illustrates a charging waveform (a) of one type of pixel voltage used to charge a pixel and a charging waveform (b) of a pixel voltage when a gate-on voltage level is lowered according to one embodiment.

FIG. 6 illustrates one type of charging waveform 6(*a*) for a pixel voltage when charging a pixel and a charging waveform 6(*b*) of pixel voltage in accordance with one embodiment when a level of gate-on voltage Von is lowered. Both waveforms 6(*a*) and 6(*b*) illustrate a relationship among gate voltage Vgate and data voltage Vdata applied to one pixel during one frame. These waveforms also include a pixel voltage Vpixel for charging the pixel. This relationship is applied in a similar manner in FIGS. 8 and 9.

In charging waveform 6(*a*), when the data voltage Vdata is applied to the pixel before and after a period 1 H and simultaneously the gate-on voltage Von is applied throughout a start and an end of period 1H, the voltage is charged to the corresponding pixel up to a level of the data voltage Vdata for period 1H.

In charging waveform 6(*b*), a gate-on voltage Von having a lower level than the level in charging waveform 6(*a*) is applied to the pixels, while other conditions may be the same as the left diagram 6(*a*). That is, an application time of the gate-on voltage Von, gate-off voltage Voff, and the data voltage Vdata are not changed except for the level of the gate-on voltage Von, in comparison with the left diagram 6(*a*). For example, when the gate-on voltage Von is 21 V and the gate-off voltage Voff is −6 V in charging waveform 6(*a*), the gate-on voltage Von may be lower than 21 V, for example, 17 V and the gate-off voltage Voff is −6 V in the charging waveform 6(*b*).

When the level of the gate-on voltage Von decreases, an on current level of the thin film transistor decreases. As a result, even though the data voltage Vdata at the same level is applied, the pixel is charged with voltage at a lower level. This also causes a charging speed of the pixel to decrease. By appropriately controlling a reduction degree of the level of the gate-on voltage Von, the charged pixel voltage Vpixel may be controlled at a level lower than one gray scale voltage.

As such, charging the pixel voltage Vpixel at the reduced level of the gate-on voltage Von may be applied to pixels which exhibit a falling response characteristic; that is, to which the data voltage Vdata is applied from a positive polarity to a negative polarity. For example, referring to FIG. 3, if the data voltage Vdata is applied to pixels indicated by a polarity of (−) from the positive polarity to the negative polarity, the gate-on voltage Von at a lower level than the level in charging waveform 6(*a*) is applied to the even numbered gate lines G2 and G4, as illustrated in charging waveform 6(*b*). The pixels connected therewith are therefore charged with voltage Vpixel at a level lower than a level of the applied data voltage Vdata.

In contrast, when the gate-on voltage Von at the level in charging waveform (a) is applied to pixels indicated by a polarity of (+), which are applied with the data voltage Vdata from the negative polarity to the positive polarity through the odd numbered gate lines G1 and G3, the pixels are charged with pixel voltage Vpixel corresponding to the level of the data-line voltage Vdata.

When the level of the gate-on voltage Von is controlled differently, as indicated above in charging waveform 6(*b*), depending on the polarity of the pixels, the rising response speed is the same but the falling response speed decreases. As a result, the rising and falling response speeds may be controlled to a similar level or substantially the same level. Therefore, since a luminance change caused by a difference in charging speed between frames or between adjacent pixels may be further reduced, the liquid crystal display may be driven without viewing a flicker at a lower frequency.

Figure 7:
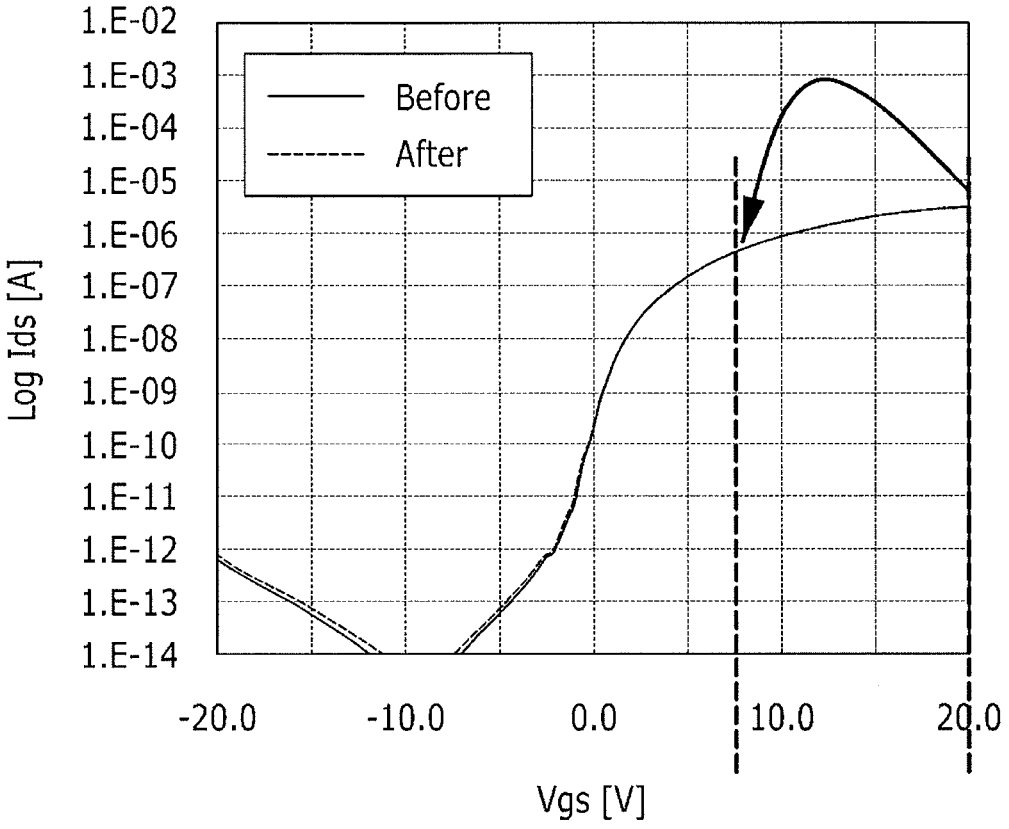
FIG. 7 illustrates an example of a charging characteristic of a pixel voltage changed by decreasing the gate-on voltage level.

FIG. 7 shows a graph showing a change in charging characteristics of the pixel voltage Vpixel produced by decreasing the level of the gate-on voltage Von relative to the data voltage. It can be seen that when the level of the gate-on voltage Von is decreased, voltage Vgs between a gate and a source of the thin film transistor decreases. As a result, current Ids between a drain and the source of the thin film transistor decreases. Consequently, even though the data voltage Vdata having the same magnitude is applied, the charging speed of the pixel voltage Vpixel decreases as compared with before decreasing the level of the gate-on voltage Von.

Figure 8:
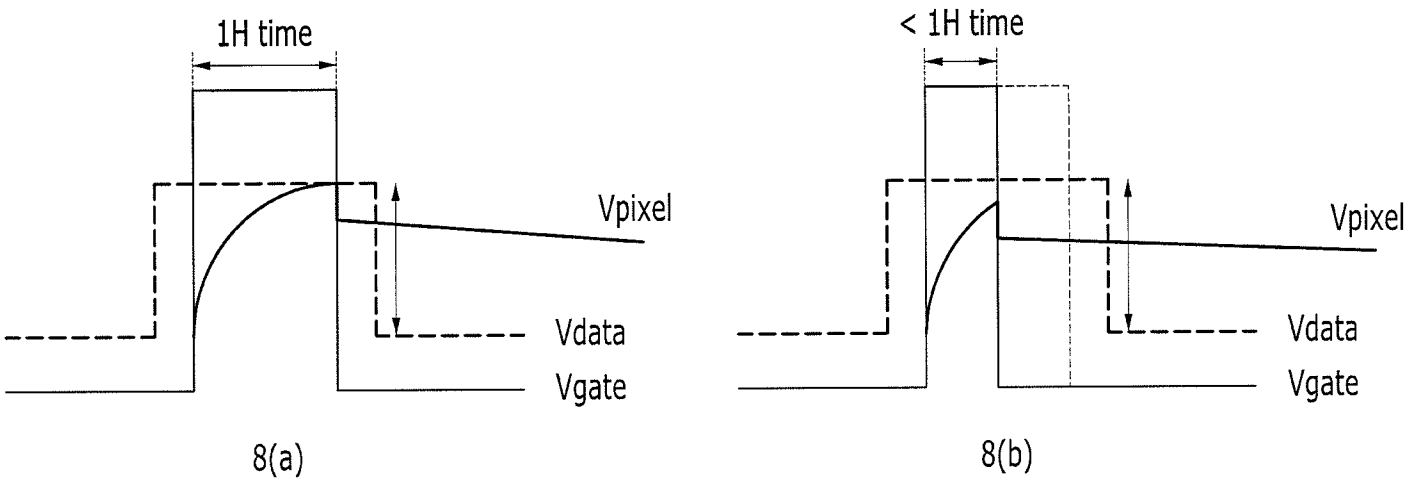
FIG. 8 illustrates a charging waveform (a) of one type of pixel voltage used to charge a pixel and a charging waveform (b) of a pixel voltage when a gate-on voltage application time is shortened according to one embodiment.

FIG. 8 illustrates a comparison of a charging waveform 8(*a*) of one type of pixel voltage when charging a pixel and a charging waveform 8(*b*) of pixel voltage when a gate-on voltage application time is shortened. Unlike the embodiment in FIG. 6, an application time of the gate voltage Vgate is shortened in FIG. 8, instead of decreasing an on level of the gate voltage Vgate as in FIG. 6.

In FIG. 8, waveform 8(*a*) illustrates the charging of one type of pixel voltage, for example, when period 1 H is 10 μs and the gate-on voltage Von has the same pulse width applied as in FIG. 6. Based on this period and gain-on voltage, the pixel is charged with the pixel voltage Vpixel corresponding to the level of the data voltage V data.

In waveform 8(*b*), the conditions are the same in as in waveform 8(*b*) except that the application time of the gate-on voltage Von is controlled to be shorter than that in waveform 8(*a*). That is, gate-on voltage Von is applied having a pulse width (for example, 8.5 μs) which is narrower than period 1 H. Therefore, the pixel voltage Vpixel is not charged up to the level of the applied data voltage Vdata and the charging stops at the time of applying the gate-off voltage Voff. By appropriately controlling the reduction of the application time of the gate-on voltage Von, the charged pixel voltage Vpixel may be controlled at a level lower than one gray scale voltage.

Charging the pixel voltage Vpixel based on a reduced application time of the gate-on voltage Von for pixels showing a falling response characteristic may slow down the falling response speed.

Figure 9:
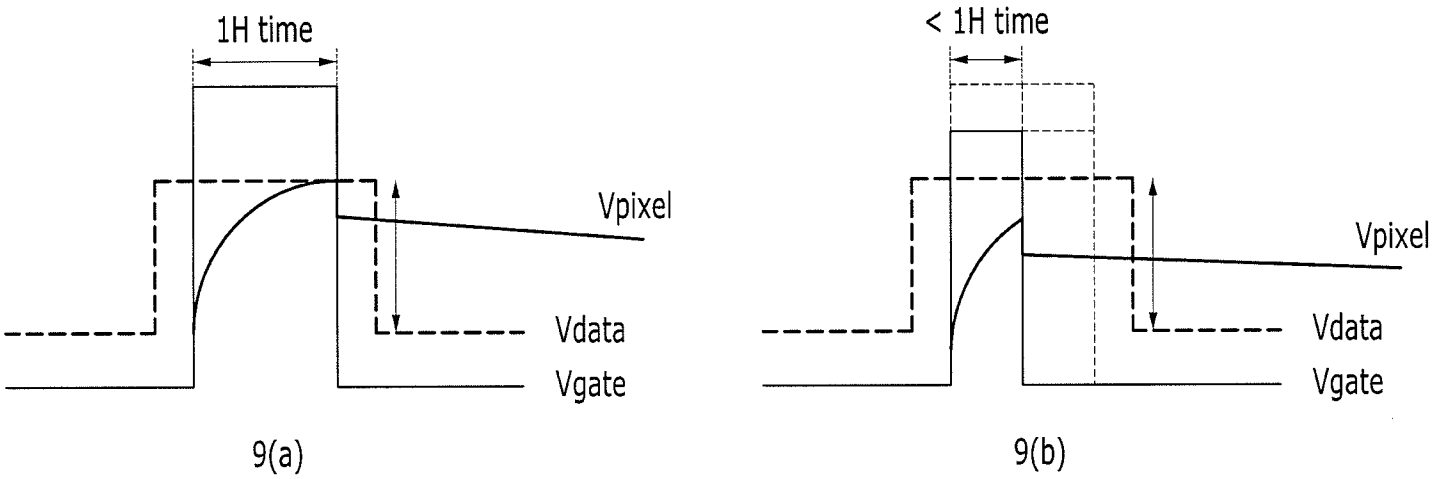
FIG. 9 illustrates a charging waveform (a) of one type pixel voltage used to charge a pixel and a charging waveform (b) of pixel voltage when the gate-on voltage level is lowered and the gate-on voltage application time is shortened according to one embodiment.

FIG. 9 shows an embodiment in which the level of the gate-on voltage Von is decreased in a manner similar to the exemplary embodiment of FIG. 6 and in which the application time of the gate-on voltage Von is shortened in a manner similar to the exemplary embodiment associated with FIG. 8.

In FIG. 9, waveform 9(*a*) corresponds to one type of charging waveform for a pixel voltage and waveform 9(*b*) illustrates a case in which the application time of the gate-on voltage is shortened and also the level of the gate-on voltage is reduced, as compared to waveform 9(*a*).

In order to show charging characteristics similar to the exemplary embodiments of FIG. 6 or 8, the level of the gate-on voltage Von may be increased as compared with the embodiment of FIG. 6(*b*) and application time of the gate-on voltage may be increased as compared with the embodiment of FIG. 8(*b*). For example, when the gate-on voltage Von is 17 V in the exemplary embodiment of FIG. 6 and the application time of the gate-on voltage Von is 8.5 μs in the exemplary embodiment of FIG. 8, the gate-on voltage Von and the application time of the gate-on voltage Von may be 19 V and 8.5 μs, respectively in this exemplary embodiment in FIG. 9(*b*).

Charging the pixel voltage Vpixel based on a reduced level and a reduced application time of the gate-on voltage Von as in waveform 9(*b*) may be applied to the pixels that show the falling response characteristic. In this case, only the falling response speed is selectively controlled to be decreased, thereby minimizing the luminance change due to the difference in response speed.

In the foregoing embodiments, the waveforms in FIGS. 6(*a*), 8(*a*), and 9(*a*) may be considered to correspond to a typical case or predetermined operational mode.

By way of summation and review, in accordance with one or more embodiments, pixel voltage may be controlled by a voltage difference which, for example, is smaller than an output voltage for one gray scale of a data driver. Also, a luminance change may result due to a difference between a rising response speed and a falling response speed, while charging of the pixel voltage can be reduced or minimized. As the luminance change is reduced or minimized, a flicker is not viewed even at the time of driving at a low frequency of 10 Hz or less. As a result, a liquid crystal display can be driven at an ultra low frequency, thereby reducing power consumption.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A liquid crystal display, comprising:

a liquid crystal display panel including a plurality of gate lines, a plurality of data lines, and a plurality of pixels arranged in a matrix pattern, each of the pixels connected to one of the gate lines and one of the data lines;

a gate driver to apply gate-on voltages to the plurality of gate lines;

a data driver to apply positive and negative data voltages to the data lines;

a signal controller to control the gate driver and the data driver, and to receive input data, wherein:

the signal controller drives the data driver and the gate driver at a motion picture frequency when the input data corresponds to a motion picture and at a still image frequency when the input data corresponds to a still image, the still image frequency being lower than the motion picture frequency, the plurality of pixels includes a first pixel and a second pixel, the first pixel being applied with a data voltage having a first polarity, and the second pixel being applied with a data voltage having a second polarity which is different from the first polarity, the plurality of gate lines includes a first gate line connected to the first pixel and a second gate line connected to the second pixel, the first pixel is applied with a first gate-on voltage via the first gate line and the second pixel is applied with a second gate-on voltage which is different from the first gate-on voltage via the second gate line when displaying the still image at the still image frequency, so as to decrease a difference between a rising response speed of one of the first and second pixels and a falling response speed of another one of the first and second pixels, and the first and second pixels are not applied with different gate-on voltages when displaying the motion picture at the motion picture frequency.

2. The liquid crystal display as claimed in claim 1, wherein the first and second gate-on voltages have different levels.

3. The liquid crystal display as claimed in claim 2, wherein:

when the data voltage applied to the first pixel is inverted from a positive polarity to a negative polarity, the first gate-on voltage applied to the first pixel has a lower level than the second gate-on voltage applied to the second pixel, and when the data voltage applied to the second pixel is inverted from a positive polarity to a negative polarity, the second gate-on voltage applied to the second pixel has a lower level than the first gate-on voltage applied to the first pixel.

4. The liquid crystal display as claimed in claim 2, wherein:

the first and second gate-off voltages have substantially a same level.

5. The liquid crystal display as claimed in claim 1, wherein:

the first and the second gate-on voltages have different widths.

6. The liquid crystal display as claimed in claim 5, wherein:

when the data voltage applied to the first pixel is inverted from a positive polarity to a negative polarity, the first gate-one voltage applied to the first pixel has a smaller width than the second gate-on voltage applied to the second pixel, and when the data voltage applied to the second pixel is inverted from a positive polarity to a negative polarity, the second gate-on voltage applied to the second pixel has a smaller width than the first gate-on voltage applied to the first pixel.

7. The liquid crystal display as claimed in claim 5, wherein:

one of the first and second gate-on voltages is applied is applied for a first period and another one of the first and second gate-on voltages is applied for a second period which is shorter than the first period.

8. The liquid crystal display as claimed in claim 1, wherein:

the first and second gate-on voltages have different levels and different widths.

9. The liquid crystal display as claimed in claim 8, wherein:

when the data voltage applied to the first pixel is inverted from a positive polarity to a negative polarity, the first gate-on voltage applied to the first pixel has a lower level and a smaller width than the second gate-on voltage applied to the second pixel, and when the data voltage applied to the second pixel is inverted from a positive polarity to a negative polarity, the second gate-on voltage of the second pixel has a lower level and a smaller width than the first gate-on voltage applied to the first pixel.

10. The liquid crystal display as claimed in claim 1, wherein:

the first gate line and the second gate line receive different gate-on voltages when displaying the motion picture.

11. The liquid crystal display as claimed in claim 10, wherein the different gate-on voltages applied to the first and second gate lines when displaying the motion picture have at least one of different levels or different widths.

12. The liquid crystal display as claimed in claim 1, wherein:

the liquid crystal display is a dot inversion driving type in which polarities among pixels that are positioned on a row and a column are inverted in the plurality of pixels arranged in the matrix pattern.

13. A driving method of a liquid crystal display, comprising:

receiving, by a signal controller, input data;

identifying, by the signal controller, whether the input data corresponds to a motion picture or a still image; and controlling, by the signal controller, a liquid crystal display panel, a gate driver, and a data driver to display the still image at a still image frequency when the input data corresponds to the still image, and the liquid crystal display panel, the gate driver, and the data driver to display the motion picture at a motion picture frequency when the input data corresponds to the motion picture, wherein:

the liquid crystal display includes a plurality of pixels including a first pixel and a second pixel, the first pixel being applied with a data voltage having a first polarity, and the second pixel being applied with a data voltage having a second polarity which is different from the first polarity, a plurality of gate lines includes a first gate line connected to the first pixel and a second gate line connected to the second pixel, and the controlling includes applying, by the gate driver, a first gate-on voltages to the first pixel via the first gate line and a second gate-on voltage, which is different from the first gate-on voltage, to the second pixel via the second gate line when the still image is to be displayed at the still image frequency, so as to decrease a difference between a rising response speed of one of the first and second pixels and a falling response speed of another one of the first and second pixels, and not applying different gate-on voltages to the first pixel and the second pixel when displaying the motion picture at the motion picture frequency.

14. The method as claimed in claim 13, wherein:

the first and second gate-on voltages have at least one of different levels or different widths.

15. The method as claimed in claim 14, wherein: the first and second gate-off voltages having substantially a same level.

16. The method as claimed in claim 14, wherein the controlling includes:

when the data voltage applied to the first pixel is inverted from a positive polarity to a negative polarity, applying, by the gate driver, the first gate-on voltage to the first pixel to have at least one of a lower level or a smaller width than the second gate-on voltage applied to the second pixel, and when the data voltage applied to the second pixel is inverted from a positive polarity to a negative polarity, applying, by the gate driver, the second gate-on voltage to the second pixel having at last one of a lower level or a smaller width than the first gate-on voltage applied to the first pixel.

17. The method as claimed in claim 13, wherein the controlling includes:

applying, by the gate driver, different gate-on voltages to the first gate line and the second gate line when a moving picture is to be displayed.

18. The method as claimed in claim 13, wherein the liquid crystal display is dot-inversion driven.

* * * * *